US005603251A

United States Patent [19]

Onishi

[11] Patent Number: 5,603,251

[45] Date of Patent: Feb. 18, 1997

[54] SHEET MATERIAL CUTTING DEVICE

[75] Inventor: Takamasa Onishi, Gumma, Japan

[73] Assignee: Onishilite Industry Co., Ltd., Gumma, Japan

[21] Appl. No.: 311,109

[22] Filed: Sep. 23, 1994

[30] Foreign Application Priority Data

Oct. 8, 1993 [JP] Japan ..... 5-252876

[51] Int. Cl.[6] ..... B26D 1/20

[52] U.S. Cl. ..... 83/487; 83/508; 83/614

[58] Field of Search ..... 83/488, 508, 582, 83/614, 636, 698.41, 487, 639.4, 578, 639.1, 639.2, 639.3, 639.5

[56] References Cited

U.S. PATENT DOCUMENTS

| | | | |
|---|---|---|---|
| 3,686,991 | 8/1972 | Fujimoto | 83/487 X |
| 3,797,339 | 3/1974 | Pape et al. | 83/614 X |
| 3,886,842 | 6/1975 | Giebel et al. | 83/639.4 X |
| 3,958,477 | 5/1976 | Carlson | 83/508 X |
| 3,973,459 | 8/1976 | Stowe | 83/614 X |
| 4,099,435 | 7/1978 | Young | 83/614 |
| 4,355,794 | 10/1982 | Costigan | 83/508 X |
| 4,859,227 | 8/1989 | Wright | 83/578 X |
| 4,869,746 | 9/1989 | Wright et al. | 83/578 X |
| 5,042,349 | 8/1991 | Komatsu | 83/488 X |
| 5,161,445 | 11/1992 | Kozyrski et al. | 83/614 X |
| 5,307,716 | 5/1994 | Onishi et al. | 83/614 X |
| 5,421,185 | 6/1995 | Castricum | 83/487 X |
| 5,431,077 | 7/1995 | Murakami | 83/508 X |
| 5,462,426 | 10/1995 | Imamura | 425/190 |

FOREIGN PATENT DOCUMENTS 50-24466 8/1975 Japan .

*Primary Examiner*—Rinaldi I. Rada
*Assistant Examiner*—Elizabeth Stanley
*Attorney, Agent, or Firm*—Foley & Lardner

[57] ABSTRACT

A screw shaft supporting structure capable of absorbing elongation of a screw shaft due to changes in environmental temperatures irrespective of the position of the rotary blade on said screw shaft is disclosed. In the sheet material cutting device, that portion of the screw shaft which is supported by a bushing and another portion thereof supported by a frame end absorbs elongation of the screw shaft due to heat. When the supporting member holding the rotary blade is positioned at A in FIG. 1, elongation of the screw shaft due to thermal expansion is absorbed in a gap formed between the stepped portion of the screw shaft and the frame end. When the supporting member holding the rotary blade is positioned at B in FIG. 1, elongation of the screw shaft due to thermal expansion is absorbed in a gap S1 formed between the stepped portion of the screw shaft and the bushing.

6 Claims, 6 Drawing Sheets

PRIOR ART

PRIOR ART

SHEET MATERIAL CUTTING DEVICE

INTRODUCTION AND BACKGROUND

The present invention relates to a sheet material cutting device which cuts a sheet material by the cooperation of a circular rotary cutting blade and a fixed cutting blade formed into a long sheet.

In prior known printers for a terminal such as ECR or POS, a strip-shaped sheet material wound into a roll is pulled out for printing, and then the necessary portion is cut into a sheet for delivery by a cutter.

Various types of such sheet material cutters are available. The rotary-type cutter requires a high manufacturing cost and causes a relatively high degree of noise and therefore is now being replaced by a cutter based on a combination of a circular rotary cutting blade moving while rotating and a fixed cutting blade formed into a long sheet (see, for example, Japanese Patent No. 50-24466/1975).

The prior known sheet material cutting device of this type will be described below with reference to FIGS. 4 through 6. FIG. 4 a side view, FIG. 5 is a sectional plan view, and FIG. 6 is a plan view of a prior known sheet material cutting device.

In FIGS. 4 through 6, 51 is the main frame of the sheet material cutting device; 52 a screw shaft; and 51*a* a frame end. As shown in FIG. 5, one end of the screw shaft 52 is supported on the main frame 51 by means of a bushing 60 while the other end is supported on the frame end 51*a* by means of another bushing 60. The screw shaft 52 is fitted to said main frame by means of a screw 62 on one end and by a pulley 61 on the other. The pulley 61 is fitted to the screw shaft 52 by means of a stop ring 63. 53 is a supporting member which is fitted to said screw shaft 52 via a screw means. A rotary blade 54 is rotatably fitted to the supporting member 53 by means of a shaft 54*a*. A fixed blade 55 is fixed on said main frame 51 by means of a screw 56.

The pulley 61 is connected to a motor 57 via the transmission mechanism 58 shown in FIG. 6. In this particular device, the screw shaft 52 rotates via a transmission mechanism 58 and the pulley 61, as the motor 57 rotates. As the screw shaft 52 rotates, the supporting member 53, which is mounted on said screw shaft 52, travels along the screw shaft 52 horizontally between positions A and B in FIG. 5. As a result, a sheet material to be cut, which is fed vertically relative to the sheets of paper shown by FIGS. 5 and 6, is cut by the cooperation of the rotary blade 54 and the fixed blade 55 as the supporting member travels horizontally.

Since in the above-mentioned sheet material cutting device said screw shaft is supported by bushing 60 on both ends thereof without considering the elongation of the screw shaft 52 due to thermal expansion, the problem described below arises.

To design a more compact and lightweight sheet material cutting device, resins are increasingly used as materials for frames, screw shafts, etc. recently. For a sheet material cutting device using a lot of resins, different types of resins are generally used for the main frame 51 and the screw shaft 52 since these have a different functional purposes. Specifically, for example, glass fiber-reinforced resins with a relatively high rigidity are frequently used for main frames, while polyacetal resins or polypropylene resins with good sliding characteristics are frequently used for screw shafts that require sliding. For this reason, when a sheet material cutting device of this type is exposed to a high temperature (60° C. or above), there occurs a difference of thermal expansion between the main frame 51 and the screw shaft 52 which are made of different materials. When said sheet material cutting device is transported on a ship, the temperature in the hold of the ship often reaches 60° C. or above, with the result that the screw shaft elongates due to heat and deforms, preventing it from operating properly thereafter.

Furthermore, prior known sheet material cutting devices tend to cut thin and soft paper only bluntly as the blades wear out, or the paper is pushed back as the blades try to cut through and is eventually cut askew. In another case, the cutting plane of the paper may be fluffy or otherwise difficult to cut sharply.

SUMMARY OF THE INVENTION

With a view to solving these conventional problems, the present invention has an object to provide a novel screw shaft supporting mechanism which absorbs elongation of the screw shaft due to change in environmental temperatures and a sheet material cutter which permits satisfactory cutting even when the sheet material to be cut is thin and soft paper.

In carrying out the present invention, the sheet material cutting device comprises a screw shaft bearing-supported on a main frame; a supporting member connected to said screw shaft by means of a screw; a rotary cutting blade rotatably mounted on said supporting member; a fixed blade fitted on said main frame; and a driving mechanism to rotate said screw shaft. The device is designed to cut a sheet material by the cooperation of the rotary blade and the fixed blade. The screw shaft is provided, on each of the both ends thereof supported by said frame, with a mechanism to absorb elongation of the screw shaft due to heat.

In further detail, the sheet material cutting device comprises a screw shaft bearing-supported on a main frame; a supporting member connected to the screw shaft by means of a screw; a rotary cutting blade rotatably mounted on the supporting member; a fixed blade fitted on the main frame; and a driving mechanism to rotate the screw shaft. It is designed to cut a sheet material by the cooperation of said rotary blade and the fixed blade. The sheet material cutting device of the present invention is provided with a mechanism to hold the sheet material when the latter is cut by the combination of the rotary blade and the fixed blade.

BRIEF DESCRIPTION OF THE DRAWINGS

The present invention will be further understood with reference to the drawings, wherein.

DETAILED DESCRIPTION OF THE INVENTION

In the sheet material cutting device of the present invention, that portion of the screw shaft which is supported by a bushing and another portion thereof supported by a frame end absorb elongation of the screw shaft due to heat is described below.

Figure 1:
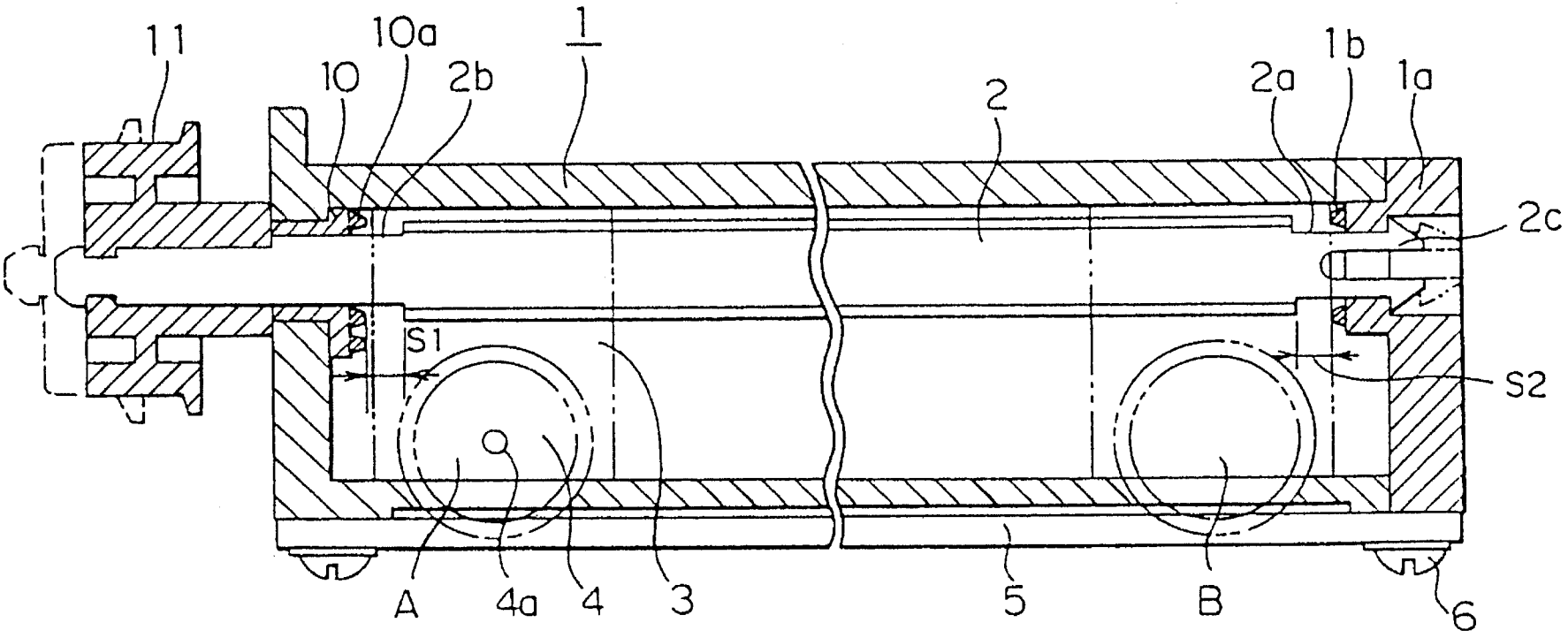
FIG. 1 is a cross-sectional plan view of the sheet material cutting device of the present invention.

When the supporting member 3 holding the rotary blade 4 is waiting in position A in FIG. 1, elongation of the screw shaft 2 due to thermal expansion is absorbed in the gap S2 formed between the stepped portion of the screw shaft and the frame end 1*a*.

When the supporting member 3 holding the rotary blade 4 is waiting in position B in FIG. 1, elongation of the screw shaft 2 due to thermal expansion is absorbed in the gap S1 formed between the stepped portion of the screw shaft and the bushing.

Furthermore, even if the sheet material to be cut is a sheet of thin and soft paper, the sheet material cutting device of the present invention cuts it satisfactorily by the cooperation of a rotary blade and a fixed blade 5 because the sheet material to be cut is pressed by a spring 14.

Embodiments of the present invention are described below with reference to the drawings.

FIG. 1 is a sectional plan view of a sheet material cutting device as an embodiment of the present invention.

It should be noted here that different symbols and numbers are used for the constituent parts and members corresponding to those in a conventional device in the description of the embodiments.

In FIG. 1, 1 is the main frame of the cutting device; 2 a screw shaft supported to said main frame at both ends; and 3 a supporting member fitted to said screw shaft. The supporting member 3 is connected to the screw shaft 2 by means of a screw. As the screw shaft rotates, the supporting member 3 travels along the screw shaft 2 horizontally. The supporting member 3 is provided with a shaft 4*a*, on which a rotary blade 4 is rotatably mounted. A fixed blade 5 is fixed on the main frame 1 with a screw 6.

In the FIG., 10 is a bushing. With this bushing 10, the screw shaft 2 is supported rotatably and slidably. The bushing 10 is held in place by the frame 1. The end face of the bushing 10 is provided with a number of protrusions 10*a* to adjust the contact pressure with the screw shaft 2. To adjust the contact pressure, the diameter of these protrusions 10*a* is changed or their height is varied gradually. On the left side of the screw shaft 2 is formed a stepped portion 2*b* to absorb elongation of the screw shaft due to thermal expansion. A gap (margin) S1 of a certain distance is formed between the stepped portion 2*b* and the protrusion 10*a* on bushing 10 which is necessary to absorb elongation of the screw shaft 2 due to heat. In addition, a pulley 11 is fixed on the end of the screw shaft 2 where it protrudes from the bushing 10.

The right-hand end of the screw shaft 2 in the figure is fitted to the frame end 1*a* rotatably and slidably. The end face of said frame end 1*a* is provided with a number of projections 1*b*, similar to those found on the bushing 10, to adjust the contact pressure with the screw shaft 2. Said contact pressure is adjustable by changing the diameter of these projections 1*b*, or changing their height gradually in the same way as for the projections 10*a*. A plastic-deformable stopper 2c is provided on the right-hand end of the screw shaft 2. Screw shaft 2 is fitted to the frame end 1*a* by being inserted into the support hole on the frame end 1*a* while effecting plastic deformation to said stopper 2*c*. With the right-hand end of the screw shaft 2 fitted to the frame end 1*a*, a gap S2 of a certain distance is formed between the screw shaft 2 and the protrusions 1*b* on the frame end 1*a*.

The screw shaft 2 is fitted on the main frame by means of the pulley 11 and the stopper 2*c* formed on the screw shaft, and the move of the screw shaft 2 in the axial direction is prevented in normal operation.

In the above sheet material cutting device, like the device described previously, the rotational power of the motor is transmitted to the pulley 11 via belts or other means of power transmission known in the art, causing the screw shaft 2 to rotate. As the screw shaft 2 rotates, the supporting member 3, mounted on the screw shaft 2, travels forward and backward along the screw shaft 2 horizontally in the figure. As a result, a sheet material fed in the direction vertical to the sheet of paper (not shown) is cut by the cooperation of the rotary blade 4 and the fixed blade 5 as the supporting member travels.

In this sheet material cutting device, elongation of the screw shaft 2 due to heat is absorbed where the screw shaft is supported by the bushing 10 as well as where it is supported by the frame end in the manner described below.

When the supporting member 3 holding the rotary blade 4 is waiting in position A in FIG. 1, elongation of the screw shaft 2 due to thermal expansion is absorbed in the gap S2 formed between the stepped portion of the screw shaft and the frame end 1*a*.

When the supporting member 3 holding the rotary blade 4 is waiting in position B in FIG. 1, elongation of the screw shaft 2 due to thermal expansion is absorbed in a gap S1 formed between the stepped portion of the screw shaft and the bushing. In this instance, the pulley 11 moves to the position shown by dotted lines due to the elongated screw shaft 2, but this positional change is accommodated by the width of the belts or the pulley 11, and the transmission of the rotational power of the motor remains unaffected.

Since a margin to absorb elongation of the screw shaft is provided on both ends of the screw shaft, elongation of the screw shaft is easily absorbed irrespective of on which side of the screw shaft the rotary blade is positioned when the device is subject to temperature change.

Furthermore, the present invention provides a plastic-deformable stopper mechanism 2*c* in the supporting portion of the screw shaft on the frame end, and the supporting portion of the screw shaft on the other end is held in place by means of the pulley 11, so that assembling requires no screws. Fixing screws are not required in the assembly of either the main frame or the frame end. For these reasons, the assembly work can be simplified.

In a further feature, the present invention provides a sheet material holding device in order to allow sharp cutting of a sheet material. A conventional sheet material cutting device tends to cut thin and soft paper only bluntly as the blades wear out, or the paper is pushed back as the blades try to cut through and is eventually cut askew. In other cases, the cutting plane of the paper is fluffy or the paper is otherwise difficult to cut sharply. With a view to solving these problems, the present invention provides a spring to hold the sheet material to be cut as shown in FIG. 2.

The construction of the sheet material holding mechanism is described below with reference to FIG. 2. FIG. 2 is a cross-sectional view of the sheet material cutting device shown in FIG. 3, at section 2—2.

Figure 2:
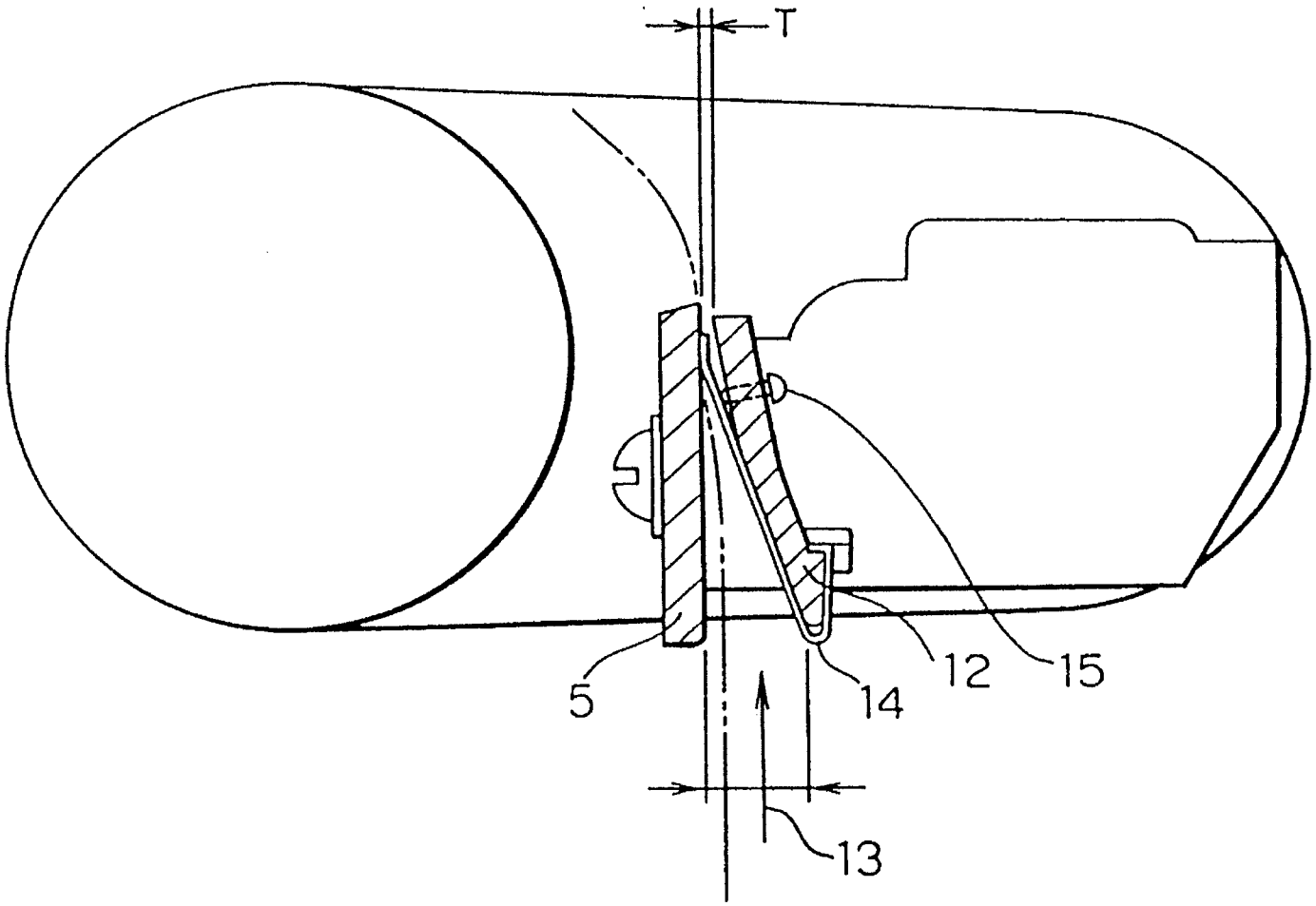
FIG. 2 is a descriptive drawing of a sheet material holding device of an embodiment of the present invention, and is a cross-sectional view of section 2—2 in FIG. 3.
Figure 3:
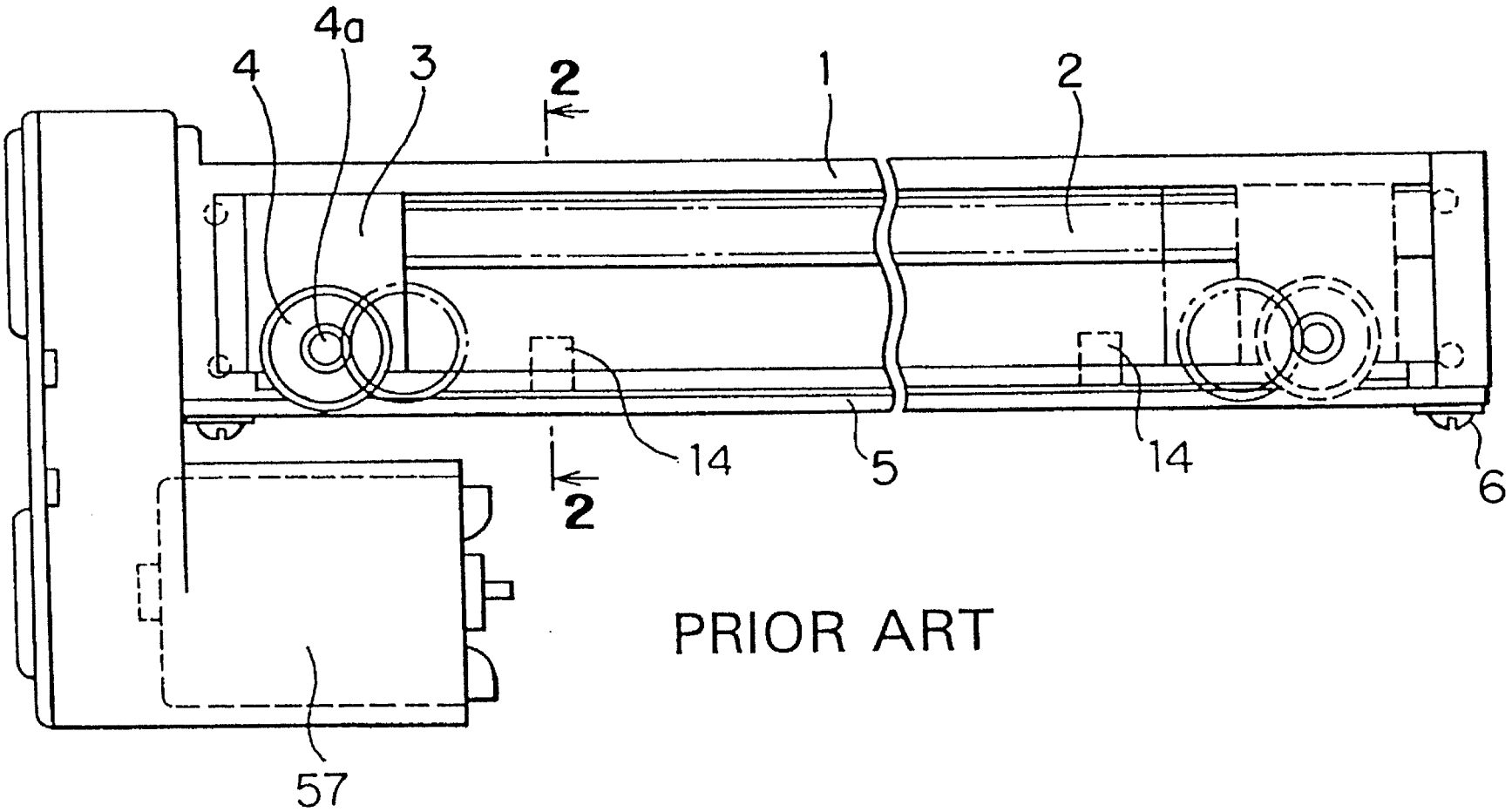
FIG. 3 a rough plan view of a sheet material cutting device of an embodiment of the present invention.
Figure 4:
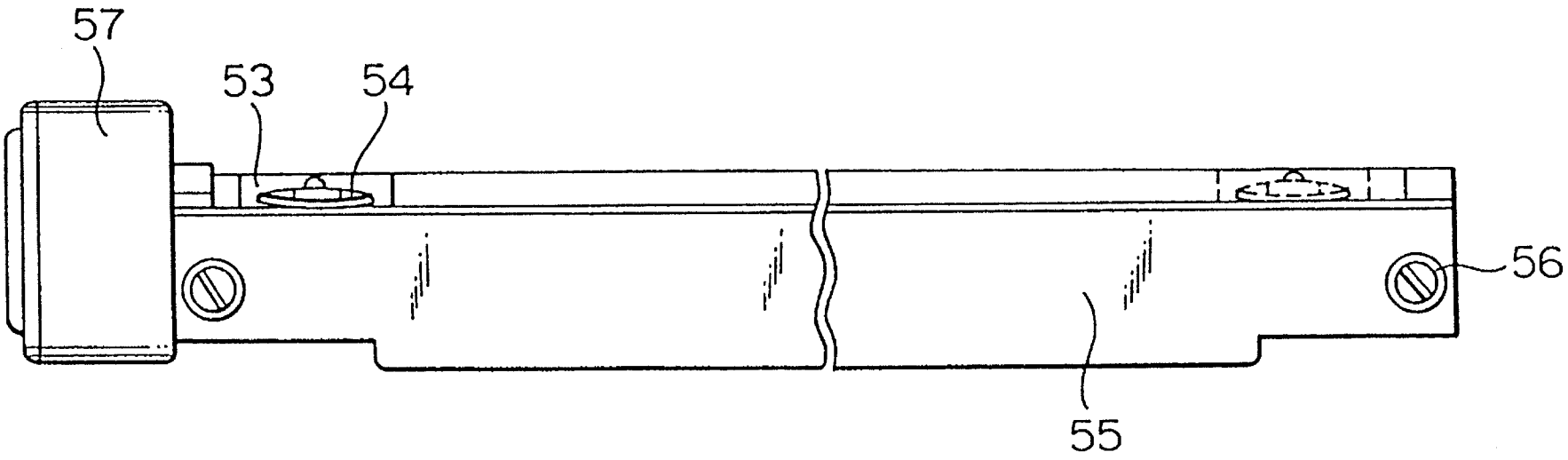
FIG. 4 PRIOR ART
FIG. 4 is a rough side view of a prior known sheet material cutting device.
Figure 5:
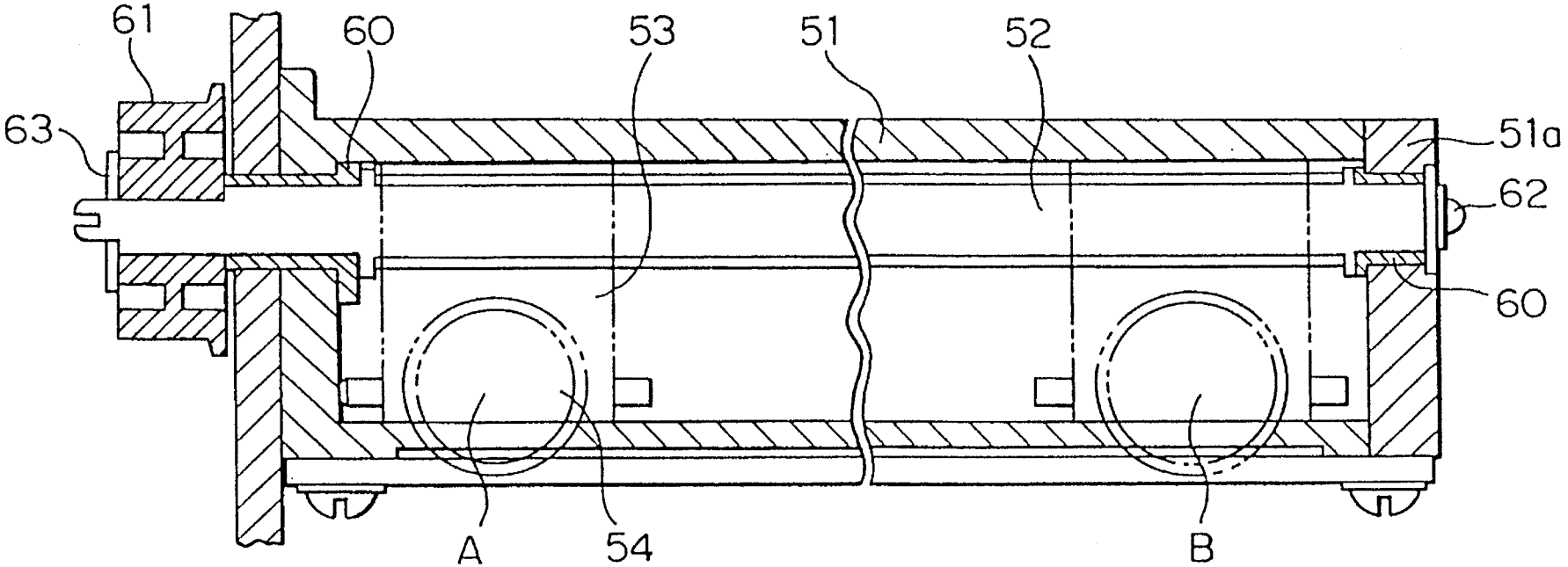
FIG. 5 is a cross-sectional plan view of a prior known sheet material cutting device.
Figure 6:
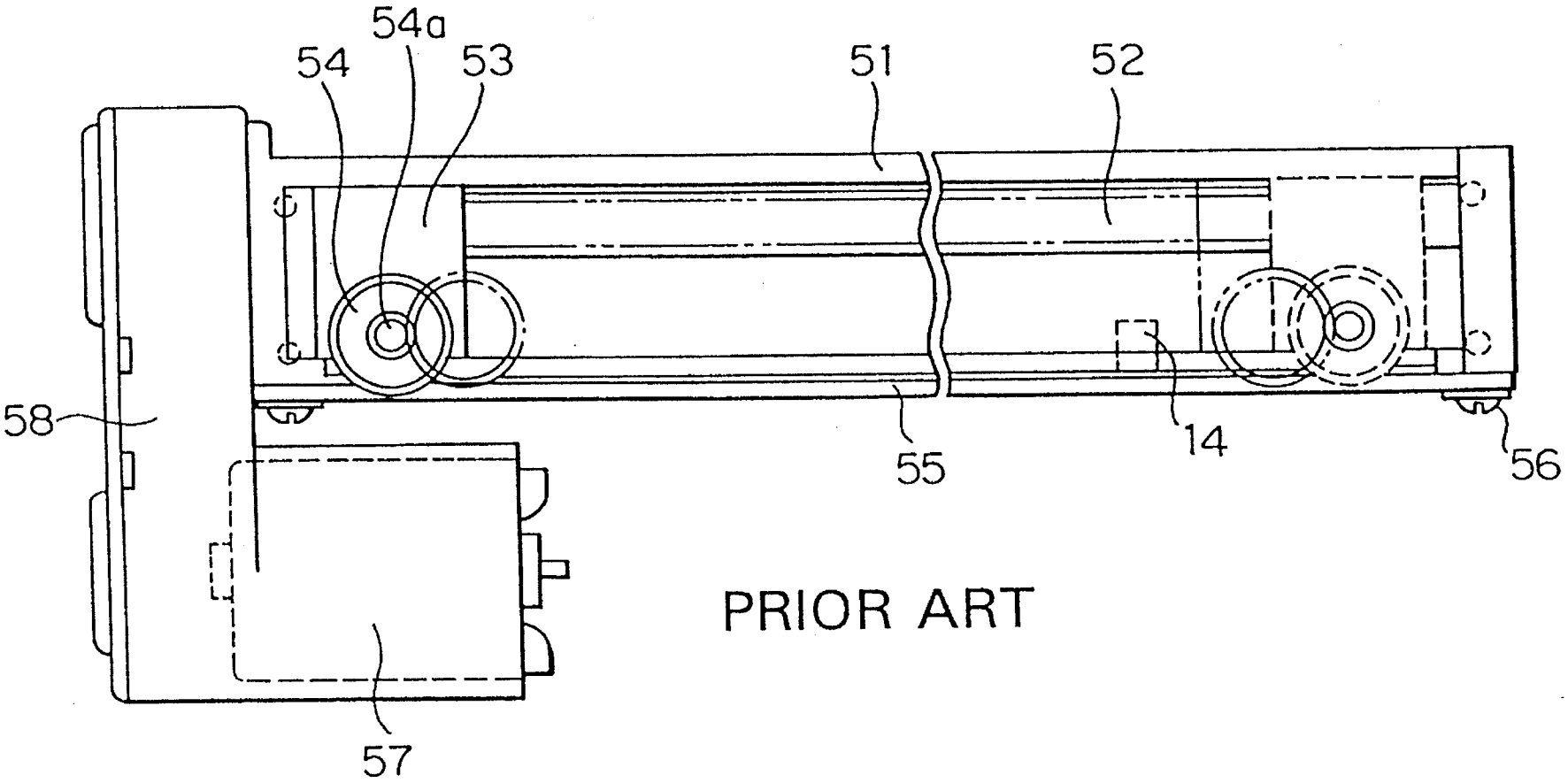
FIG. 6 is a rough plan view of a prior known sheet material cutting device.

In FIG. 2, 5 is a fixed blade. A sheet material guide member 12 in the form of a long sheet is provided opposing this fixed blade 5 maintaining a certain gap T. The sheet material guide member 12 is provided with an appropriate number of plate springs 14 to hold a sheet material to be cut. The plate springs 14 are fitted in engagement with the sheet material guide member 12. They do not obstruct proper feeding of soft paper and have the function of preventing the paper from being returned by the cutting resistance of the rotary blade. In addition, the springs 14 are adjustable in terms of spring force. The spring force of these springs is adjusted by a screw 15 which is provided to adjust the pressing force of the springs fitted on the guide member 12.

A sheet material is fed in the arrow 13 direction in the figure and cut by the cooperation of the rotary blade and the fixed blade 5. In this instance, the sheet material is held by the springs 14. Owing to this pressing force, even if the sheet material to be cut is thin and soft paper, the paper is not returned to be cut bent, nor is the cutting plane fluffy and it is possible to cut the sheet material satisfactorily.

In the above embodiments, the frame end and the supporting portion of the screw shaft may have any other structure than the above so long as said structure allows absorbance of elongation of the screw shaft due to heat. In addition, the engagement of the screw shaft and the frame is not limited to the stopper described herein but any of other various means may be employed so long as such means prevent falling. Furthermore, the springs 14 to hold the sheet material to be cut are not limited to the springs but any other various means may be employed so long as such means have the function of holding a sheet material with an appropriate level of contact pressure. It should be noted that the spring pressing force adjusting mechanism (screw 15 in the above embodiment) is installed only when necessary, and may be omitted if a particular application does not require adjustment of spring pressing force. Furthermore, the number of places where a sheet material is to be held with an appropriate contact pressure is determined in accordance with the width of the sheet material to be cut and other considerations.

The present invention may be implemented in various other forms of embodiment without deviating from the spirit of the main features thereof. The above-mentioned embodiments are therefore only a few examples and should not be construed as limiting. All variations and alterations falling under the scope of equivalents to the patent claims come under the scope of the present invention.

As described in detail in the above, the sheet material cutting device of the present invention absorbs elongation of the screw shaft due to a change in the environmental temperatures irrespective of on which end of said screw shaft the rotary blade may be positioned in the waiting state with a very simple structure and for this reason: it is possible to prevent deformation of the screw shaft under a high temperature condition. Furthermore, because the present invention provides a plastic-deformable stopper on the supporting portion of the screw shaft on the frame end while the supporting portion of the other end of the screw shaft is held in place by a pulley, no screws or other devices are required for assembly of the unit, and the assembly of the main frame and the frame end can be performed without using fixing screws either, thus the assembly work can be simplified. Furthermore, this invention provides a sheet material holding device to allow sharp cutting of a sheet material so that it cuts a sheet material satisfactorily even if the sheet material to be cut is thin and soft paper, and otherwise the sheet material cutting device of the present invention has various excellent effects.

What is claimed is:

1. A sheet material cutting device comprising: a screw shaft bearing-supported on a main frame; a supporting member connected to said screw shaft by a screw; a rotary cutting blade rotatably mounted on said supporting member; a fixed blade fitted on said main frame; and a driving mechanism to rotate said screw shaft wherein each end of said screw shaft is fitted to said main frame rotatably as well as slidably in an axial direction so as to allow absorbance of elongation of the screw shaft due to heat.

2. A sheet material cutting device as claimed in claim 1, wherein each end of said screw shaft is without screw-threads over a certain length.

3. A sheet material cutting device as claimed in claim 1, wherein said main frame supporting said screw shaft is provided with a stress absorbing mechanism to absorb stress which is generated when said screw shaft is elongated and comes in contact with said main frame.

4. A sheet material cutting device as claimed in claim 1, wherein an elastic-deformable stopper is fitted on one end of said screw shaft while a drive pulley mounting unit is fitted on another end thereof, wherein said screw shaft is fitted to said main frame by said elastic-deformable stopper and the drive pulley.

5. A sheet material cutting device according to claim 1, further comprising a sheet material holding mechanism to hold a sheet material to be cut.

6. A sheet material cutting device as claimed in claim 5, wherein said sheet material holding mechanism comprises a spring which is pressed onto the sheet material to hold the sheet material to be cut.

* * * * *